United States Patent [19]

LoFaso et al.

[11] Patent Number: 4,507,988

[45] Date of Patent: Apr. 2, 1985

[54] BEVERAGE RECEPTACLE OPENER

[76] Inventors: Joseph S. LoFaso; Mardi I. LoFaso, both of 4232 Miguel View Dr., La Mesa, Calif. 92041; Kenneth R. Gold, 6450 Via Arboles, Anaheim, Calif. 92087

[21] Appl. No.: 442,729

[22] Filed: Nov. 18, 1982

[51] Int. Cl.[3] ..... B67B 7/00

[52] U.S. Cl. ..... 81/3.09; 81/3.29; 81/3.56; D8/40

[58] Field of Search ..... 81/3.1 R, 3 R, 3.34, 81/3.4, 3.44, 3.38 R, 3.38 A, 3.46 R, 3.46 A; 7/151; D8/33, 34, 40, 43; 220/285, 274; 294/26

[56] References Cited

U.S. PATENT DOCUMENTS

| | | | |
|---|---|---|---|
| D160,081 | 9/1950 | Galter | D8/40 |
| D269,587 | 7/1983 | Hanslmair | D8/40 |
| 3,460,411 | 8/1969 | Dyer | 81/3.34 |
| 3,812,741 | 5/1974 | Heine | 81/3.4 |
| 4,206,561 | 6/1980 | Wong et al. | 81/3 R X |
| 4,253,352 | 3/1981 | O'Neal | D8/40 X |
| 4,309,921 | 1/1982 | Miller | 294/26 X |
| 4,398,314 | 8/1983 | Converse et al. | 7/151 |
| 4,409,863 | 10/1983 | Anderson | 81/3.46 R X |
| 4,414,865 | 11/1983 | Brooks et al. | 81/3.46 R X |

FOREIGN PATENT DOCUMENTS

| | | | |
|---|---|---|---|
| 27609 | 7/1930 | Australia | 81/3.46 |
| 699533 | 11/1953 | United Kingdom | 81/3.46 A |

*Primary Examiner*—Frederick R. Schmidt
*Assistant Examiner*—Debra S. Meislin
*Attorney, Agent, or Firm*—Albert L. Gabriel

[57] ABSTRACT

An opener for assisting in the opening of beverage cans of the type having a pull-up tab which levers a scored closure segment of the lid down into the can and beverage bottles of the type having a twist-off cap. The opener has an elongated body with a can tab actuator at one end and bottle cap torqueing structure at the other end. The tab actuator is bent or inclined relative to the main body of the opener so that the main body provides a down-turned handle for operating the tab actuator, while the tab actuator provides a down-turned handle for operating the cap torqueing structure. The tab actuating structure has opposed, open-sided lower and upper jaws, with a longitudinally arranged rib on the upper jaw defining both a narrow, tab-gripping notch between the jaws and a lead-in ramp for guiding a tab into the notch.

5 Claims, 11 Drawing Figures

FIG. 8
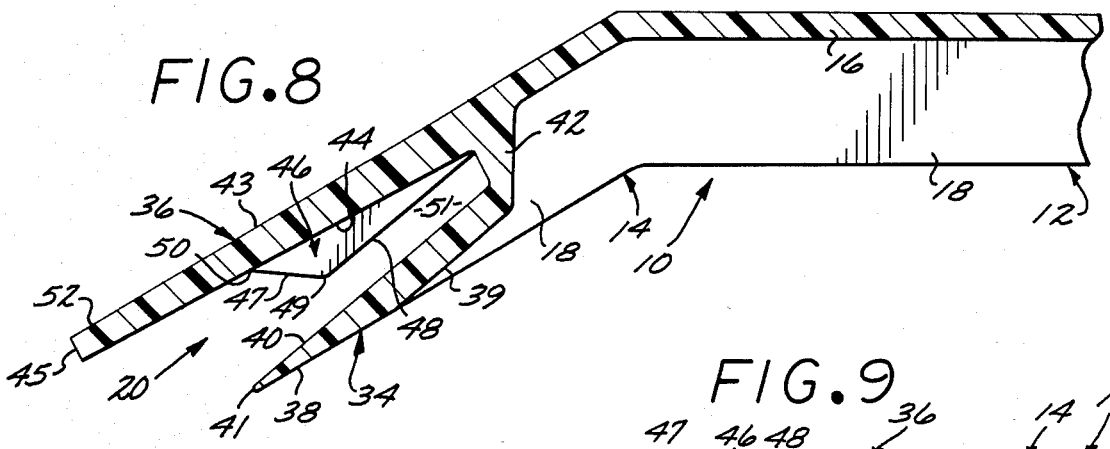
FIG. 9
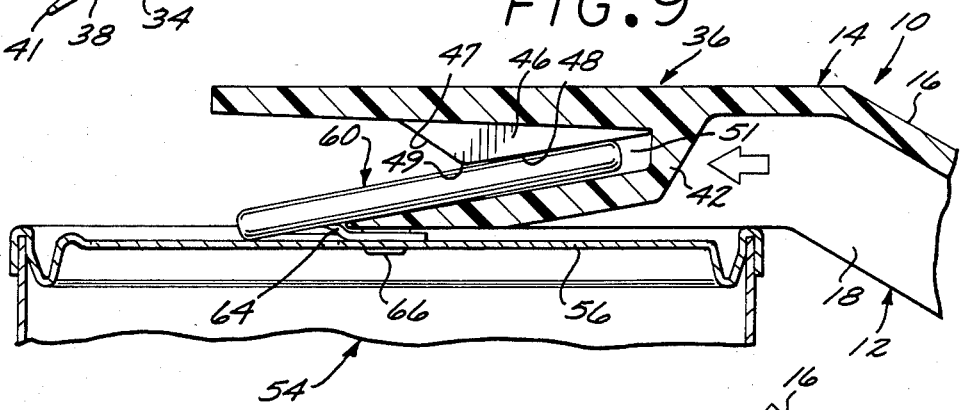
FIG. 10
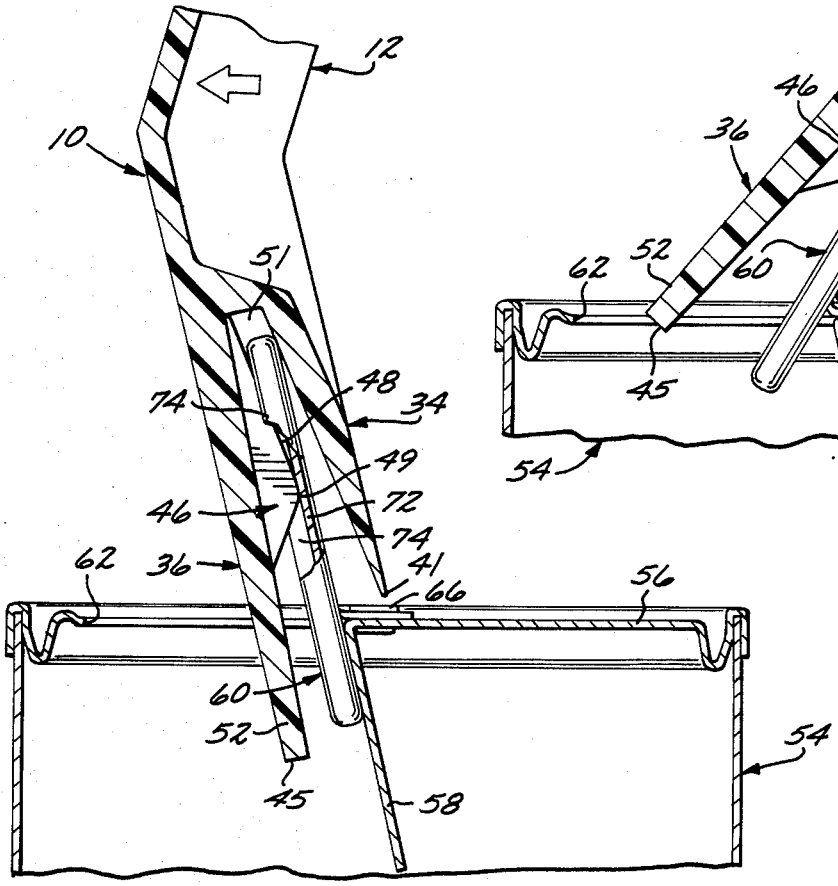
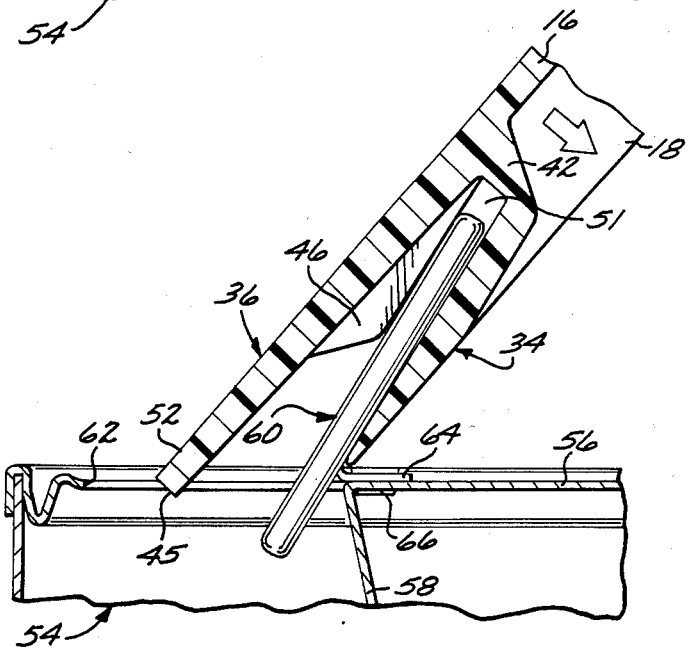
FIG. 11

BEVERAGE RECEPTACLE OPENER

BACKGROUND OF THE INVENTION

1. Field of the Invention

The present invention is in the field of beverage receptacle openers, and it relates more particularly to tools for assisting in the manipulation of pull-up can opening tabs of the type which lever a scored closure down into the can, and to tools for assisting in the opening of twist-off type bottle caps.

2. Description of the Prior Art

Beverage cans have come into widespread usage which employ a stay-on pull-up tab which opens the can by first popping a scored closure segment of the lid loose and then levering the closure segment down into the can. While such pull tab-type beverage can openers are intended to be initially lifted by a fingernail from close proximity to the lid surface and then levered by finger pressure, in practice such tabs require so much lifting force, particularly during the initial movement thereof upwardly away from the surface of the lid, that they are difficult or impossible for many people to operate directly with the fingers, and they frequently result in broken fingernails when direct finger manipulation is attempted. Accordingly, there have been several prior art tools designed to assist in the manipulation of beverage can opening tabs of this type.

One such tool is disclosed in U.S. Pat. No. 4,253,352 and consists of an elongated, flat tube or sleeve having a forwardly opening mouth adapted to be engaged longitudinally over the can opening tab, with closed side walls for transversely locating the tab within the tube or sleeve. One of the disclosed forms has a forwardly projecting extension of the top wall of the flat tube or sleeve to assist the tab in opening the scored closure segment of the can lid. In practice, this tool has proven to be difficult to use, the blunt forward end of the lower wall being awkward to get under the tab, the close spacing between the upper and lower walls, the forwardly projecting part of the upper wall and the closed side walls making initial engagement of the tool with the tab difficult to visually align and generally critical.

A similar prior art tool is disclosed in U.S. Pat. No. 4,309,921, this tool having a generally flat metal body with a downwardly stamped bridge that is intended to be engaged under the tab. This bridge has a sharpened leading edge to assist in the initial engagement with the tab, but the wide, flat metal body and the closed side walls forming a part of the stampedout bridge, as with the tool discussed in the immediately preceding paragraph, made initial engagement of the tool with the tab generally critical and difficult to visually align.

Another tool which applicants have observed on the market has a wide wedge-shaped lower element and a much narrower finger-shaped upper element that curves upwardly and forwardly in widely spaced relationship above the lower element. While the wedge-shaped lower element is readily engageable under a pull tab and visibility is good, the upper finger, because of both its curved contour and wide spacing from the lower element, leaves the tab generally loose and ungripped in the device and this makes manipulation of the tab awkward. Constant forward force must be applied to keep the tool engaged with the tab. This tool has no side walls nor any other lateral alignment means, so that it presents a continuing alignment problem during manipulation of a pull tab.

Another type of tab opening tool is disclosed in U.S. Pat. No. 4,257,287, wherein a hook at the front end of the tool engages and pulls up on the free end of the tab while a leg member pushes down against the scored closure segment of the lid. In operation, the handle of this tool extends in the opposite direction from the pull tab and the handle is pushed down rather than being pulled up, which make this device unnatural and awkward to use.

Beverage bottle caps intended to be gripped and twisted off by the hand without requiring the use of a conventional flip-up type of bottle cap opener have also come into widespread usage. However, these bottle caps require so much torque to be twisted off that many people are incapable of removing such twist-off caps without the aid of a tool, and even for people capable of twisting them off by hand the tight grip around the serrated periphery of the bottle cap will generally cause considerable discomfort. One tool designed to mechanically assist both the tightening and the removing of twist-type bottle caps is disclosed in U.S. Des. Pat. No. 249,452 and consists of an internally groved cup attached to the longitudinal center of a short, flat, generally sharp-edged handle that would still appear to involve some discomfort in use.

SUMMARY OF THE INVENTION

In view of these and other problems in the art, it is an object of the present invention to provide a beverage receptacle opener which, in a single tool, has working portions at both of its ends, one of which is adapted to engage and operate a pull-tab beverage can opener, and the other of which adapted to engage and torque off a twist-off type bottle cap, each working end portion of the tool providing handle means and extending the lever arm for operating the opposite working end portion of the tool.

Another object of the invention is to provide an elongated opener with a beverage can tab actuator at one end and bottle cap torqueing structure at the other, the tab actuator being bent or inclined relative to the main body of the opener so that the main body provides a down-turned handle for operating the tab actuator in a generally vertical plane relative to an upright can while the tab actuator provides a down-turned handle for operating the cap torqueing structure in a generally horizontal plane relative to an upright bottle.

A further object of the invention is to provide an opener for beverage cans of the pull-tab type which has forwardly opening jaws that are widely spaced apart for ease of engagement over the tab, yet wherein one of the jaws has a longitudinally arranged rib therein that defines a narrow tab-gripping notch between the jaws and a ramp for guiding the tab into the notch, the narrowness of the notch providing a positive gripping of the can opening tab for actuating the tab first in a can opening direction and then in a tab return direction to move the tab back down out of the way.

A still further object of the invention is to provide an opener of the character described for beverage cans of the pull-tab type wherein the tab-gripping jaws are open-sided to facilitate visual alignment during the initial engagement of the tab between the jaws, yet wherein a laterally centered, longitudinally arranged gripping rib that defines the tab-gripping notch between the jaws is operatively engageable in the recessed central web section of the tab to maintain lateral positioning between the jaws and the tab during the entire can opening stroke of the tool.

Yet a further object of the invention is to provide an opener of the character described for beverage cans of the pull-tab type having lower and upper tab-gripping jaws, the lower jaw being wedge-shaped with a generally sharp leading edge to facilitate engagement of the lower jaw under the tab and to initiate opening tilting movement of the tab by an upward camming action of the wedge against the tab.

An additional object is to provide an opener of the character described wherein the upper jaw has a nose that projects forwardly beyond the leading edge of the lower jaw so as to break the seal of the scored closure on the can lid if the pull-tab should fail in this function.

The beverage receptacle opener of the invention has an elongated, generally straight body with tab actuating structure formed on its forward end portion for engaging and operating a pull-tab type beverage can opener and bottle cap torqueing structure formed on its rearward end portion for engaging and torqueing off a bottle cap of the twist-off type. The forward end portion of the opener, including the tab actuating structure, is downwardly bent or inclined relative to the main body or handle so as to provide a particularly advantageous angle of attack of the tool when engaging and operating a can pull tab, and to also provide an advantageously tilted handle structure for operating the bottle cap torqueing structure. The bottle cap torqueing structure similarly provides an enlarged, rounded handle to facilitate operation of the tab actuating structure.

The tab actuating structure includes opposed, forwardly opening lower and upper jaws. The lower jaw has a generally sharp leading edge and is wedge-shaped so as to be easily insertable under a can pull tab that may lie closely adjacent the lid of a can, and so as to initiate opening movement of the tab by camming the free end of the tab upwardly along the upper surface of the wedge. The upper jaw is generally widely spaced from the lower jaw in the region of the leading edge of the lower jaw so that the initial angle of attack of the tool relative to the tab is not critical. A longitudinally arranged, laterally centered rib extends from the upper jaw toward the lower jaw, the rib having a rearward straight edge portion that is parallel to and closely spaced above the upper surface of the lower jaw to define a narrow tab-gripping notch; while a forward edge on the rib provides a lead-in ramp for guiding the tab into the gripping notch. The center rib on the upper jaw enables the sides of the jaws to be completely open for visual assistance in the initial engagement and manipulation of the pull tab, while the rib laterally interlocks with the recessed central web part of the tab for positive lateral positioning between the tab and the opener through the complete arc of an opening stroke. The upper jaw has a forward nose that projects beyond the front edge of the lower jaw so as to overlie the scored closure segment of the can lid and operate as a back-up to break the seal of the scored closure segment in the event the tab itself should fail to break the seal; this nose on the upper jaw being tapered and contoured generally to register in shape with the typical scored closure segment on a can lid.

BRIEF DESCRIPTION OF THE DRAWINGS

These and other objects of the invention will become more apparent in reference to the following description and the accompanying drawings, wherein:

FIG. 8 is a fragmentary axial, vertical section, partly in elevation, illustrating details of construction of the tab actuating structure of the opener;

FIG. 9 is an enlarged, fragmentary vertical section taken on the line 9—9 in FIG. 7 showing the tab actuating structure of the opener fully engaged with a can pull tab so that the tab has been cammed upwardly by the lower jaw, but before the opener has been levered upwardly;

FIG. 10 is a view similar to FIG. 9, but with the tool levered upwardly to the fully opened condition of the can lid; and FIG. 11 is a view similar to FIGS. 9 and 10 illustrating the return tilting movement of the opener and the tab back down toward the position of FIG. 9 after the can has been opened.

DETAILED DESCRIPTION

Figure 1:
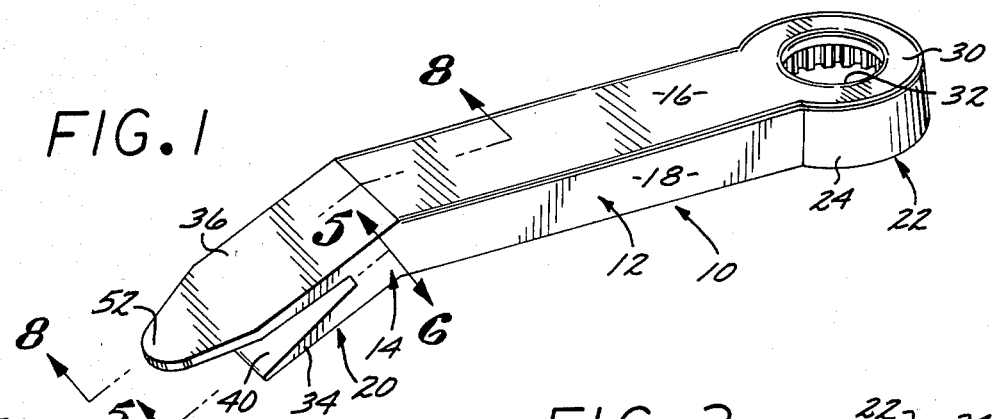
FIG. 1 is a perspective view of the beverage receptacle opener of the invention.
Figure 2:
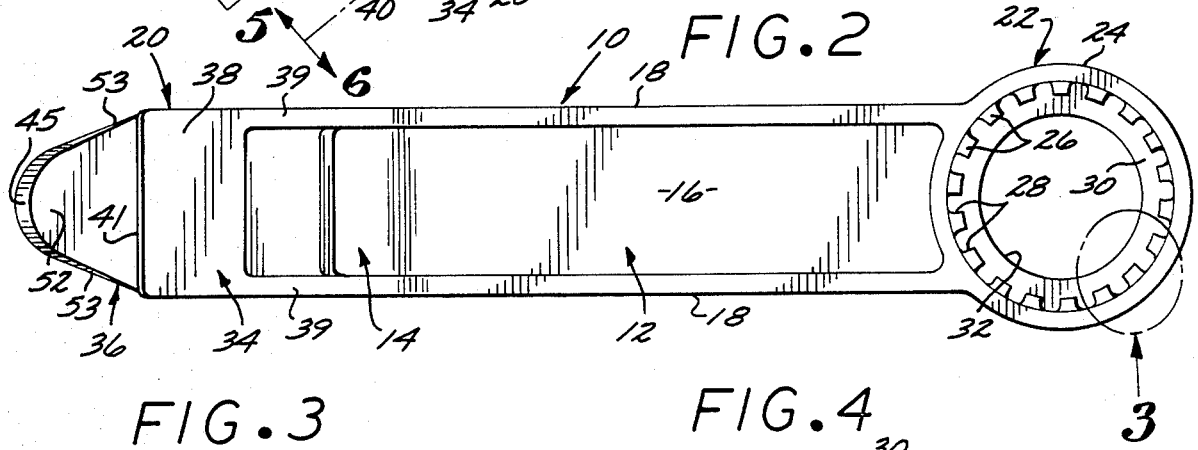
FIG. 2 is an enlarged bottom plan view of the opener.
Figure 3:
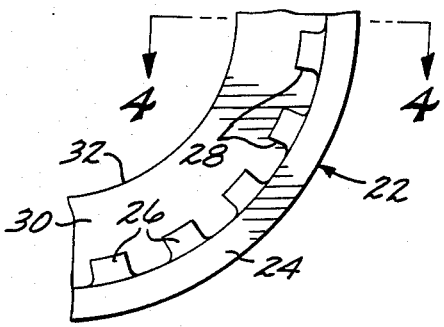
FIG. 3 is a further enlarged, fragmentary bottom plan view of the region designated "3" in FIG. 2.

Referring to the drawings, the beverage receptacle opener of the present invention is generally designated 10, and its principal structural basis is an elongated, rigid body 12 which is straight for most of its length, but has a downwardly inclined forward end portion 14 that is inclined at a preferred angle of approximately 30° relative to the main length of body 12. The entire elongated body 12, including the downwardly inclined forward end portion 14 thereof, has a downwardly opening channel-shaped configuration formed by a generally flat top wall 16 and a pair of flat, parallel, depending side rails 18. Extending forwardly from body 12 is tab actuating structure 20 which is formed as an axial extension of the downwardly inclined forward end portion 14 of body 12. Thus, both the forward end portion 14 of body 12 and the tab actuating structure 20 are inclined relative to the main part of elongated body 12, preferably at an angle of approximately 30°. Extending rearwardly from elongated body 12 generally in alignment therewith is bottle cap torqueing structure 22. Preferably the body 12, tab actuating structure 20 and cap torqueing structure 22 are integrally molded as a single unit of rigid plastic material.

The terms "front," "rear," "upper," "lower," and similar terms of reference are employed herein for convenience and clarity of description, and not by way of limitation.

Figure 4:
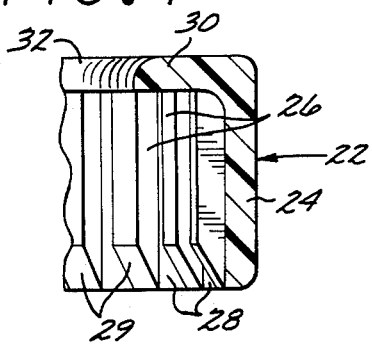
FIG. 4 is a fragmentary sectional view taken on the line 4—4 in FIG. 3.

Details of construction of the bottle cap torqueing structure 22 are illustrated in FIGS. 1–4. The torqueing structure 22 includes an annular, generally cylindrical, downwardly opening bottle cap receiver 24, the cylindrical axis of which is preferably at right angles to the top wall 16. Alternating gripping ribs 26 and grooves 28 are regularly spaced around the inside of receiver 24. The gripping ribs 26 and grooves 28 are parallel to the cylindrical axis of receiver 24, and the ribs 26 have lead-in bevels 29 at their lower ends, as seen in FIG. 4. The receiver 24 has a flat, annular top wall 30 which is formed as an extension of the top wall 16 of elongated body 12. The annular top wall 30 defines a central circular opening or window 32 at the top of receiver 24 for observing the correct positioning of a bottle cap within the receiver 24.

The bottle cap torqueing structure 22 is operated by grasping the elongated body 12 as a handle in one hand and axially engaging the receiver 24 over a bottle cap so that the peripheral ribbing on the cap is engaged in the grooves 28 between the gripping ribs 26, such engagement of the receiver 24 over the bottle cap being aided by the lead-in bevels 29 on the ribs 26. Then, the entire length of the opener 10 is available as a lever arm to torque off even the most unyielding of "twist-off" type bottle caps. The downward incline of tab actuating structure 20 and forward end portion 14 of body 12 places these portions of the opener 10 at a favorable angle relative to the torqueing axis, which is the cylindrical axis of receiver 24, for grasping the forward portions of the tool in the hand, and applying the necessary torque.

The tab actuating structure 20 includes opposed lower and upper jaws generally designated 34 and 36, respectively, which open forwardly to receive a can opening tab therebetween generally in the axial direction of both the tab and the tab actuating structure 20. The jaws 34 and 36 are also open at the sides thereof for visual assistance in achieving the correct axially centered alignment of the can opening tab between the jaws.

As seen in FIGS. 1 and 8–11, the lower jaw 34 is wedge-shaped when viewed from the side, or in axial, vertical section. The bottom of wedge-shaped lower jaw 34 is defined by a forward flat bottom surface 38 and the bottom edges 39 of side rails 18 in forward body portion 14 which form a straight-line rearward continuation of bottom surface 38. The bottom surface 38 and bottom edges 39 are parallel to the general downwardly inclined longitudinal axis of the tab actuating structure 20. The top of the wedge shape of lower jaw 34 is defined by a flat upper surface 40 that is rearwardly and upwardly inclined relative to bottom surface 38 and bottom edges 39, and hence also relative to the general longitudinal axis of tab actuating structure 20, at an angle preferably of approximately 10°. The bottom surface 38 and upper surface 40 meet at a transverse leading edge 41 of the lower jaw 34 that is generally sharp to assure ease of entry of lower jaw 34 between the free, handle end of the can opening tab and the lid of the can. The lower jaw 34 is connected at its rear end to the upper jaw 36 by means of a transverse rear wall 42 which extends continuously from one side to the other of the opener 10. Thus, the lower jaw 34 is structurally supported relative to the upper jaw 36 by both of the side rails 18 and by the transverse rear wall 42.

The upper jaw 36 has flat top and bottom surfaces 43 and 44, respectively, which converge forwardly from the root of upper jaw 36 at rear wall 42 forwardly to the forwardmost tip 45 of upper jaw 36. Thus, upper jaw 36 has a uniform taper from thicker to thinner forwardly from its root, maximizing its beam strength proximate its root where the greatest vertical bending loads will be applied to the upper jaw 36 because of its cantilever-type construction.

Figure 5:
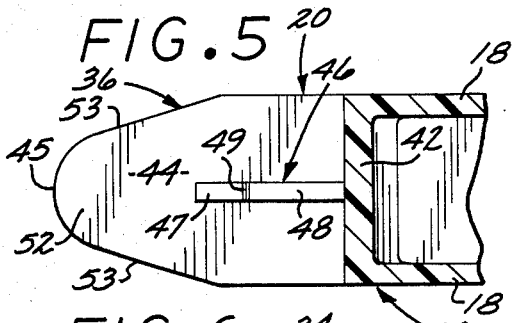
FIG. 5 is an enlarged, fragmentary sectional view taken on the line 5—5 in FIG. 1 showing the upper jaw and a forward portion of the body of the tool.
Figure 6:
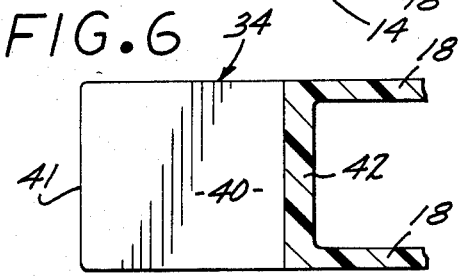
FIG. 6 is an enlarged, fragmentary sectional view taken on the line 6—6 in FIG. 1 showing the lower jaw and a forward portion of the body of the tool.

Projecting downwardly from the bottom surface 44 of upper jaw 36 is a longitudinally arranged rib 46 which is, as seen in FIG. 5, axially centered between the sides of upper jaw 36. The rib 46 is triangular in profile, having a relatively short forward edge 47 and a relatively long rearward edge 48, the edges 47 and 48 meeting at apex 49. The forward end 50 of rib 46 is displaced rearwardly of the leading edge 41 of lower jaw 34 in the axial direction of tab actuating structure 20. This places the entire forward edge 47 of rib 46 well to the rear of the forwardmost portion of lower jaw 34. The forward edge 47 extends rearwardly and downwardly relative to the general longitudinal axis of tab actuating structure 20, whereby forward edge 47 serves as a lead-in guide for the free, handle end of the can opening tab.

The reardward edge 48 of rib 46 is substantially parallel to the flat upper surface 40 of lower jaw 34, and extends from apex 49 upwardly and rearwardly relative to the general longitudinal axis of tab actuating structure 20 to the transverse rear wall 42. The straight rearward edge 48 of rib 46 and the straight upper surface 40 of lower jaw 34 define between them from apex 49 to rear wall 42 a straight tab-gripping notch 51 which is inclined rearwardly and upwardly relative to the general longitudinal axis of tab actuating structure 20, preferably at an angle of approximately 10°. Thus, the tab-gripping notch 51 is oriented at a greater angle relative to the axis of the main part of elongated body 12 than the general longitudinal axis of tab actuating structure 20, the tab-gripping notch 51 preferably being oriented at an angle of approximately 40° relative to the longitudinal axis of the main part of elongated body 12.

The presence of rib 46 on the underside of upper jaw 36 enables a wide entrance gap to be provided between the leading edge 41 of lower jaw 34 and the bottom surface 44 of upper jaw 36 to facilitate engagement of the free, handle end of a can opening tab between the jaws 34 and 36; then the entrance ramp provided by the forward edge 47 of rib 46 positively guides the free handle end of the tab into the gripping notch 51; and then the narrowness of the notch 51 between edge 48 and surface 40 relative to the extended length of notch 51 provides a positive gripping of the handle part of the can opening tab in the notch 51 for actuating the tab first in a can opening direction and then in a tab return direction to move the tab back down generally parallel to the lid of the can where it is out of the way. Preferably, the tab-gripping notch 51 has a length that is at least approximately five times its height between surface 40 and edge 48.

Figure 7:
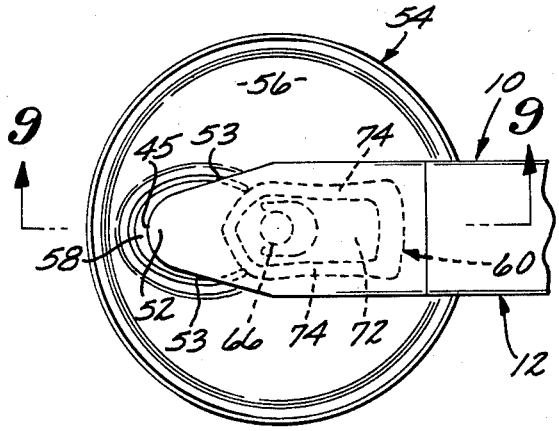
FIG. 7 is a fragmentary top plan view illustrating the opener in its initially engaged position fully engaged with a can opening tab and with the nose of the upper jaw overlying the scored closure segment of the can lid.

The upper jaw 36 has a forward nose portion 52 that projects forwardly beyond the leading edge 41 of lower jaw 34. The purpose of nose 52 is to break the seal of the scored closure on the can lid if the pull-up tab should fail in this function. To enable the jaws 34 and 36 to be wider than the widest can opening tab, while nevertheless the nose 52 is sufficiently narrow and properly contoured to be able to break the scored closure seal and push the closure down into the can, the nose 52 has tapered side edges 53 that taper forwardly and inwardly toward the axial center of upper jaw 36, leading into a rounded forward tip 45 of the upper jaw 36. As best seen in FIG. 7, this inwardly tapered, rounded configuration of the nose 52 places it in a generally overlapping location above the scored closure on the can lid and provides the nose 52 with a curvature that generally registers with the curvature of the typical scored closure, only with the forward part of the nose 52 narrower than the typical scored closure.

Referring now to FIGS. 7 and 9–11, a typical beverage can of the type having a stay-on pull-up can opening tab is generally designated 54, and has a lid 56 with a scored closure segment 58 thereon that is adapted to be levered down into the can by a can opening tab 60 to leave an opening 62 in the lid 56 through which the beverage may be poured. The tab 60 has a fulcrum web 64 extending from its underside, the web 64 being attached to the lid 56 by means of a rivet 66 extending through the lid 56 proximate the center thereof. The tab 60 includes an elongated pull-up handle portion 68 and a short push-down portion 70 which extend in opposite directions from the fulcrum of tab 60 proximate the rivet 66. In the initial condition of the can 54 before an opening sequence commences, the tab 60 lies parallel to and closely adjacent the lid 56, with the elongated handle portion 68 extending diametrically oppositely from the scored closure segment 58 and the short push-down portion 70 overlying the scored closure segment 58 near the rivet 66.

To operate the opener 10, the elongated body 12 is grasped in one hand and the tab actuating structure 20 is generally axially aligned with the elongated pull-up handle portion 68 of can opening tab 60. Then, the leading edge 41 of lower jaw 34 is engaged under the free end of the tab handle 68 and the wedge-shaped lower jaw 34 is advanced all of the way under the tab handle 68 until leading edge 41 comes up to the fulcrum web 64, which is the position illustrated in FIGS. 7 and 9. Although the tab actuating structure 20 is shown substantially parallel to the lid 56 in FIG. 9, it is to be understood that because of the wide entrance gap between the leading edge 41 of lower jaw 34 and the bottom surface 44 of upper jaw 36, followed by the entrance ramp edge 47 of rib 46, such substantially parallel orientation of tab actuating structure 20 relative to can lid 56 is not necessary, and the tab actuating structure 20 may be tilted at a considerable angle relative to lid 56 when the lower jaw 34 is engaged under the tab handle 68 and the tab handle 68 is thereby engaged within the tab-gripping notch 51.

This initial sliding engagement movement of the opener 10 to the position of FIGS. 7 and 9 cams the tab 60 through its initial opening arc of tilting movement about the fulcrum web 64. Then, the opener 10 is tilted up from the position of FIG. 9 until the scored closure segment 58 is popped down into the can generally as seen in FIG. 10, with the forwardly projecting nose portion 52 of upper jaw 36 pushing the scored closure segment 58 down into the can should the short push-down portion 70 of tab 60 fail to do so. During the tilting of the opener 10 from its initially engaged position of FIG. 9 through an arc of tilting movement of approximately 90°, the bend of approximately 30° between the main part of elongated body 12 and the tab actuating structure 20 will enable the tab 60 to be tilted all of the way over center as shown in FIG. 10 without requiring that the main part of elongated body 12 be brought even up to the vertical, which considerably facilitates this can opening movement of the opener 10.

As seen in FIG. 9, when the tab handle 68 is fully engaged within the gripping notch 51 preparatory to the levering movement of opener 10 from the position of FIG. 9 to that of FIG. 10, the forward end portion 14 of elongated body 12 spaces the main part of elongated body 12 out over the rim of the can lid 56 so that the full engagement of tab handle 68 in gripping notch 51 is not in any way interfered with by the bottom edges of the rails 18 of the main part of elongated body 12.

As soon as the opener 10 starts to be levered up from the position of FIG. 9 toward the position of FIG. 10, the narrow rib 46 will seat down within a recessed central web section 72 found in most tabs 60 and defined between raised or beaded sides 74 of the tab 60. This has the effect of interlocking the tab actuating structure 20 and the tab 60 in the transverse direction without requiring view-obstructing side walls such as were required in the prior art to laterally locate the tab within the opener. This interlocking engagement between tab actuating structure 20 and the tab 60 is illustrated in FIG. 10, and is present during the entire opening levering stroke from the position of FIG. 9 to the position of FIG. 10.

After the can has been fully opened as in FIG. 10, then the opener 10 is levered back down as illustrated in FIG. 11, preferably all of the way down to the position of FIG. 9 in which the tab 60 is substantially completely out of the way of a person who might to wish to drink directly from the can. Such generally full return movement of the tab 60 by the opener 10 is enabled by the narrow gap of the tab gripping notch 51 as the usually beaded or raised free end of the tab handle 68 is engaged by the upper edge 48 of notch 51 during the return stroke.

While thus employing the opener 10 to open a can of the stay-on pull-up tab type, the rounded enlargement provided by the bottle cap torqueing structure 22 at the rear end of the opener serves as a convenient handle for manipulating the opener 10, and also provides an elongation of the torque arm available to facilitate the opening and return tilting movements of the opener 10.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the appended claims.

We claim:

1. An opener for actuating the tab of a beverage can of the type having a pull-up tab that opens a scored closure segment of the can lid and has a recessed central section, said opener comprising:

an elongated rearward body;

elongated forward tab actuating structure extending generally longitudinally from said body, said tab actuating structure comprising spaced-apart, generally longitudinally arranged lower and upper jaws, said upper jaw having a generally downwardly-facing lower surface and said lower jaw having an opposed, generally upwardly-facing upper surface, said opposed surfaces defining between them a forwardly opening slot which is substantially open-sided; and an elongated, longitudinally arranged, substantially transversely centered rib on said upper jaw extending downwardly from said lower surface of the upper jaw toward said upper surface of the lower jaw, said rib and said upper surface of the lower jaw defining a tab-gripping notch therebetween;

said rib being engageable within said recessed central section of said tab so as to interlock said tab-actuating structure and said tab in the transverse direction;

said rib having a forward edge extending rearwardly and downwardly from said lower surface of the upper jaw so as to define a lead-in ramp for guiding said pull-up tab into said tab-gripping notch;

said rib having a rearward edge defining the upper surface of said tab-gripping notch; and said rib having a generally triangular side profile, said forward and rearward edges of said rib meeting at an apex that is engageable within said recessed central section of said tab.

2. An opener as defined in claim 1, wherein said opposed surfaces diverge forwardly so as to facilitate entry of said tab therebetween.

3. An opener as defined in claim 2, wherein said lower jaw is substantially wedge-shaped in side profiles, converging forwardly to a generally sharp leading edge so as to facilitate entry of said lower jaw between said tab and said can lid.

4. An opener as defined in claim 1, wherein said tab-gripping notch is generally straight and has a longitudinal axis that is downwardly and forwardly inclined relative to a general longitudinal axis of said tab-actuating structure.

5. An opener as defined in claim 4, wherein a general longitudinal axis of said tab-actuating structure is downwardly and forwardly inclined relative to a general longitudinal axis of said body.

* * * * *